US011236946B2

(12) United States Patent
Mercer et al.

(10) Patent No.: US 11,236,946 B2
(45) Date of Patent: Feb. 1, 2022

(54) MICROCHANNEL HEAT EXCHANGER

(71) Applicant: Carrier Corporation, Palm Beach Gardens, FL (US)

(72) Inventors: Kevin Mercer, Danville, IN (US); James Amick, Coatesville, IN (US); Arindom Joardar, Jamesville, NY (US); Robert A. Leffler, Salt Lake City, UT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/869,850

(22) Filed: May 8, 2020

(65) Prior Publication Data

US 2020/0355439 A1 Nov. 12, 2020

Related U.S. Application Data

(60) Provisional application No. 62/846,027, filed on May 10, 2019.

(51) Int. Cl.

| | |
|---|---|
| ***F28F 9/02*** | (2006.01) |
| ***F28D 7/00*** | (2006.01) |
| ***F28F 1/02*** | (2006.01) |

(52) U.S. Cl.

CPC ..... *F28D 7/0066* (2013.01); *F28F 1/02* (2013.01); *F28F 2260/02* (2013.01)

(58) Field of Classification Search

CPC ..... F28D 7/0066; F28F 1/02; F28F 2260/02
USPC ..... 165/173
See application file for complete search history.

(56) References Cited

U.S. PATENT DOCUMENTS

| | | | | |
|---|---|---|---|---|
| 4,708,197 | A * | 11/1987 | Robbins | F24F 12/001 165/54 |
| 5,181,395 | A | 1/1993 | Carpenter et al. | |
| 7,921,904 | B2 | 4/2011 | Matter et al. | |
| 8,387,410 | B2 | 3/2013 | Cho et al. | |
| 9,354,000 | B2 | 5/2016 | Wang et al. | |
| 9,377,253 | B2 | 6/2016 | Hwang et al. | |
| 9,528,770 | B2 | 12/2016 | Jiang et al. | |
| 10,161,658 | B2 | 12/2018 | Russo et al. | |
| 10,215,444 | B2 | 2/2019 | Kopko et al. | |

(Continued)

FOREIGN PATENT DOCUMENTS

| | | |
|---|---|---|
| CN | 201652995 U | 11/2010 |
| CN | 201892351 U | 7/2011 |

(Continued)

OTHER PUBLICATIONS

Climetal Heat Exchangers., "Microchannel V-Shaped Technology", Madrid Spain, 6 pages. http://climetal.com/industrial/microchannel-v-shaped-technology.html.

*Primary Examiner* — Davis D Hwu
(74) *Attorney, Agent, or Firm* — Cantor Colburn LLP

(57) ABSTRACT

A heat exchanger includes a plurality of heat exchange tube segments defining a plurality of fluid pathways therein and a bend formed in the plurality of heat exchange tube segments defining a first leg of the heat exchanger positioned at a first side of the bend, and a second leg of the heat exchanger positioned at a second side of the bend opposite the first side. The heat exchanger is positioned relative to a flow direction of an incoming airflow such that the bend is closer to a source of the incoming airflow than the first leg and the second leg.

18 Claims, 4 Drawing Sheets

(56) References Cited

U.S. PATENT DOCUMENTS

| | | | | |
|---|---|---|---|---|
| 2010/0132917 | A1 | 6/2010 | Runk et al. | |
| 2014/0196872 | A1* | 7/2014 | Anwar | F28F 1/10 165/109.1 |
| 2016/0014929 | A1* | 1/2016 | Jaworowski | H05K 7/20254 165/104.19 |
| 2017/0130974 | A1 | 5/2017 | Mercer et al. | |
| 2017/0198973 | A1* | 7/2017 | Bugler | F28F 1/36 |
| 2017/0356700 | A1 | 12/2017 | Joardar | |
| 2018/0094874 | A1* | 4/2018 | Sakamaki | F28D 1/05391 |

FOREIGN PATENT DOCUMENTS

| | | | |
|---|---|---|---|
| CN | 102135350 | B | 3/2013 |
| CN | 101806550 | B | 2/2014 |
| CN | 104089498 | B | 3/2016 |
| CN | 103968610 | B | 7/2016 |
| CN | 105091412 | B | 3/2018 |
| CN | 109114690 | A | 1/2019 |
| WO | 2016036732 | A1 | 3/2016 |

* cited by examiner

MICROCHANNEL HEAT EXCHANGER

CROSS-REFERENCE TO RELATED APPLICATIONS

This application claims the benefit of U.S. Provisional Patent Application Ser. No. 62/846,027 filed May 10, 2019, the disclosure of which is incorporated herein by reference in its entirety.

BACKGROUND

Exemplary embodiments pertain to the art of heat exchangers. More particularly, the present disclosure relates to the support of folded or bent microchannel heat exchangers.

Microchannel heat exchangers have emerged in the market as an effective heat transfer surface for HVAC applications. Evaporators in residential applications is an area where system size, cost and performance are driving equipment sizes and pricing.

Recently, interest in folded or ribbon bent heat exchangers has increased. Typical heat exchanger configurations, however, expose a large portion of the inside cabinet interior lining containing the heat exchanger to the cold discharge air of the heat exchanger, such as an 'A' Coil configuration. As such, the cabinet requires insulation for greater efficiency and to prevent heat loss. Further, such heat exchangers often require a large drain pan to capture condensate from the coil.

BRIEF DESCRIPTION

In one embodiment, a heat exchanger includes a plurality of heat exchange tube segments defining a plurality of fluid pathways therein and a bend formed in the plurality of heat exchange tube segments defining a first leg of the heat exchanger positioned at a first side of the bend, and a second leg of the heat exchanger positioned at a second side of the bend opposite the first side. The heat exchanger is positioned relative to a flow direction of an incoming airflow such that the bend is closer to a source of the incoming airflow than the first leg and the second leg.

Additionally or alternatively, in this or other embodiments the bend is positioned lower vertically than the first leg and the second leg.

Additionally or alternatively, in this or other embodiments a drain pan is positioned vertically below the bend.

Additionally or alternatively, in this or other embodiments the first leg and the second leg define a mixing area therebetween for mixing of a discharge airflow of the heat exchanger.

Additionally or alternatively, in this or other embodiments a header is positioned at at least one of the first leg or the second leg.

Additionally or alternatively, in this or other embodiments the heat exchanger is installed in a housing/cabinet substantially surrounding the heat exchanger.

Additionally or alternatively, in this or other embodiments the bend has an included bend angle of 90 degrees or less.

Additionally or alternatively, in this or other embodiments the bend angle is between 15 and 45 degrees.

Additionally or alternatively, in this or other embodiments the heat exchanger is substantially V-shaped.

Additionally or alternatively, in this or other embodiments the heat exchanger is configured as an evaporator of a vapor compression cycle.

In another embodiment, a heating, ventilation and air conditioning system includes a condenser configured to condense a flow of refrigerant flowing therethrough and an evaporator operably connected to the condenser and configured to exchange thermal energy between the refrigerant flowing through the evaporator and an airflow directed across the evaporator. The evaporator includes a plurality of heat exchange tube segments defining a plurality of fluid pathways therein, and a bend formed in the plurality of heat exchange tube segments defining a first leg of the evaporator positioned at a first side of the bend, and a second leg of the evaporator positioned at a second side of the bend opposite the first side. The evaporator is positioned relative to a flow direction of an incoming airflow such that the bend is closer to a source of the incoming airflow than the first leg and the second leg.

Additionally or alternatively, in this or other embodiments the bend is positioned lower vertically than the first leg and the second leg.

Additionally or alternatively, in this or other embodiments a drain pan is positioned vertically below the bend.

Additionally or alternatively, in this or other embodiments the first leg and the second leg define a mixing area therebetween for mixing of a discharge airflow of the heat exchanger.

Additionally or alternatively, in this or other embodiments a header is positioned at at least one of the first leg or the second leg.

Additionally or alternatively, in this or other embodiments the evaporator is installed in a housing/cabinet substantially surrounding the evaporator.

Additionally or alternatively, in this or other embodiments the bend has an included bend angle of 90 degrees or less.

Additionally or alternatively, in this or other embodiments the bend angle is between 15 and 45 degrees.

Additionally or alternatively, in this or other embodiments the evaporator is substantially V-shaped.

Additionally or alternatively, in this or other embodiments one or more fins extend between adjacent heat exchange tube segments of the plurality of heat exchange tube segments.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
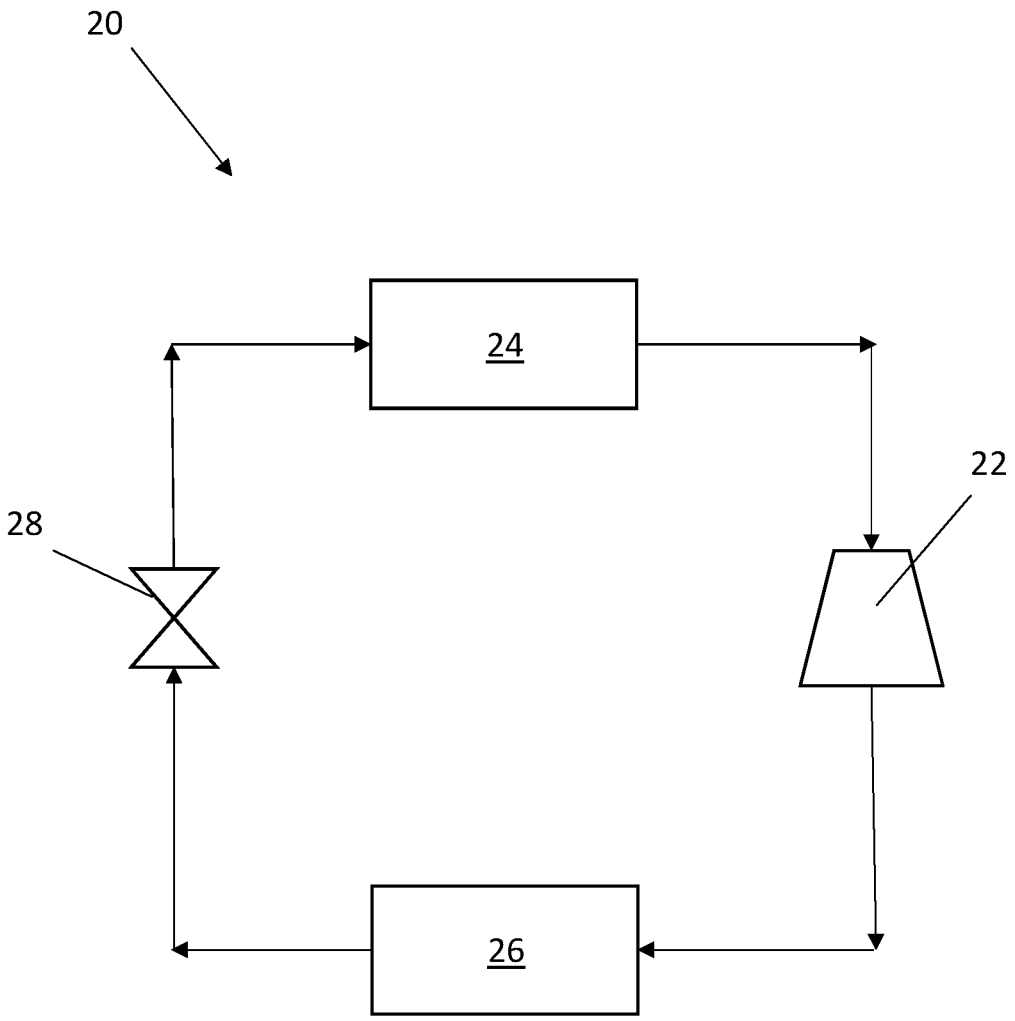
FIG. 1 is a schematic view of an embodiment of a vapor compression cycle.

Referring now to FIG. 1, a vapor compression refrigeration cycle 20 of a heating, ventilation, air conditioning, and refrigeration (HVAC&R) system is schematically illustrated. Exemplary HVAC&R systems include, but are not limited to, residential, split, packaged, chiller, rooftop, supermarket, and transport HVAC&R systems, for example. A refrigerant R is configured to circulate through the vapor compression cycle 20 such that the refrigerant R absorbs heat when evaporated at a low temperature and pressure and releases heat when condensed at a higher temperature and pressure.

Within this vapor compression refrigeration cycle 20, the refrigerant flows in a counterclockwise direction as indicated by the arrow. The compressor 22 receives refrigerant vapor from the evaporator 24 and compresses it to a higher temperature and pressure, with the relatively hot vapor then passing to the condenser 26 where it is cooled and condensed to a liquid state by a heat exchange relationship with a cooling medium (not shown) such as air. The liquid refrigerant R then passes from the condenser 26 to an expansion device 28, wherein the refrigerant R is expanded to a low temperature two-phase liquid/vapor state as it passes to the evaporator 24. The relatively cold two-phase refrigerant mixture then passing to the evaporator 24 where it is boiled to a vapor state by a heat exchange relationship with a heating medium (not shown) such as air. The low pressure vapor then returns to the compressor 22 where the cycle is repeated.

Figure 2:
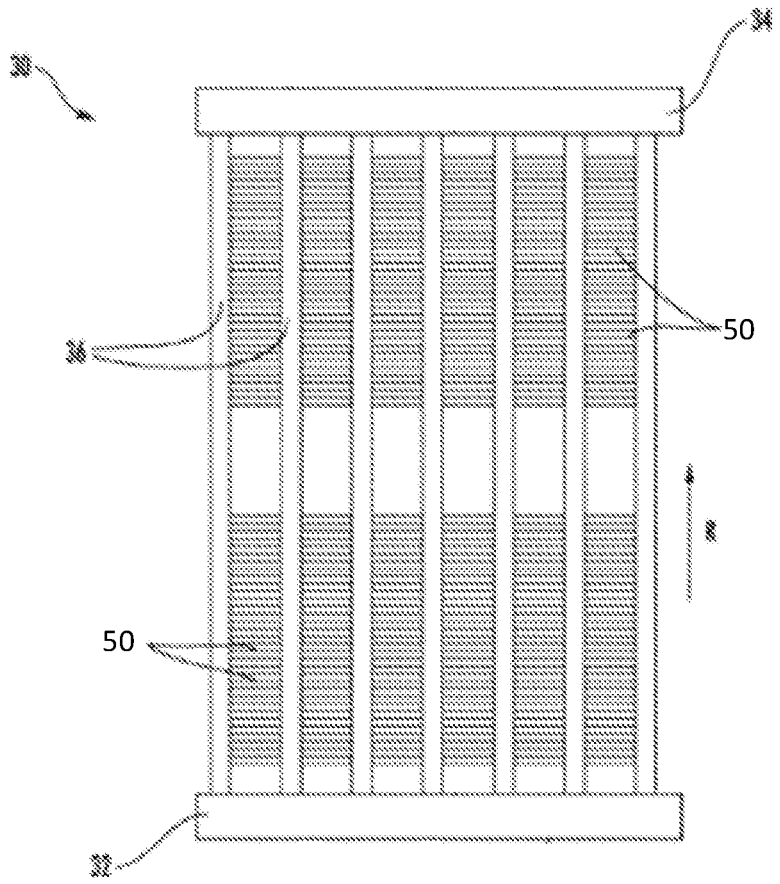
FIG. 2 is a schematic illustration of an embodiment of an evaporator of a vapor compression cycle.

Referring now to FIG. 2, an example of an evaporator 24 is illustrated in more detail. The evaporator 24 includes at least a first manifold or header 32, a second manifold or header 34 spaced apart from the first manifold 32, and a plurality of heat exchange tube segments 36 extending in a spaced, parallel relationship between and connecting the first manifold 32 and the second manifold 34. In the illustrated, non-limiting embodiments, the first header 32 and the second header 34 are oriented generally along a first direction and the heat exchange tube segments 36 extend generally along a second direction between the two headers 32, 34.

Figure 3:
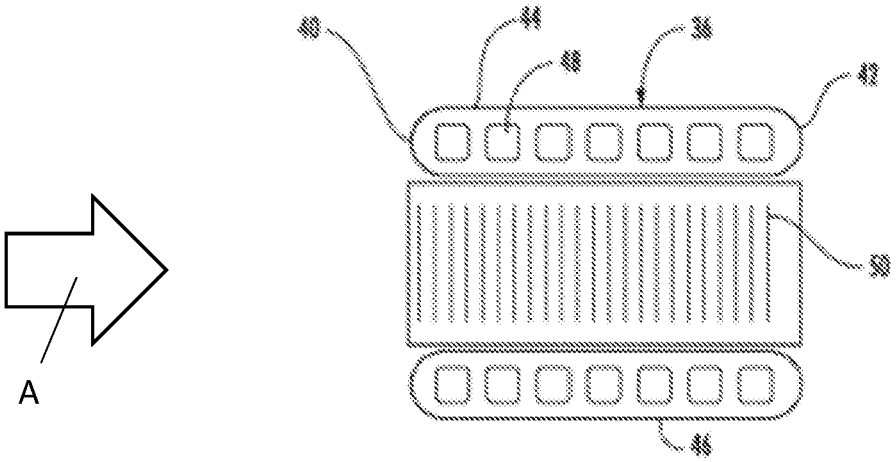
FIG. 3 is a cross-sectional view of an embodiment of a heat exchange tube and fin segment.

Referring now to FIG. 3, a cross-sectional view of an embodiment of a heat exchange tube segment 36 is illustrated. The heat exchange tube segment 36 includes a flattened microchannel heat exchange tube having a leading edge 40, a trailing edge 42, a first surface 44 and a second surface 46. The leading edge 40 of the heat exchange tube segment 36 is upstream of its respective trailing edge 42 with respect to airflow A passing through the heat exchanger 30 and flowing across the heat exchange tube segment 36. An interior flow passage of the heat exchange tube segment 36 may be divided by interior walls into a plurality of discrete flow channels 48 that extend over a length of the heat exchange tube segment 36 from an inlet end to an outlet end and establish fluid communication between the first and second manifolds 32, 34. The flow channels 48 may have a circular cross-section or, for example, a rectangular cross-section, a trapezoidal cross-section, a triangular cross-section or another non-circular cross-section. The heat exchange tube segment 36 including discrete flow channels 48 may be formed using known techniques and materials, including but not limited to, extruding or folding.

The heat exchange tube segments 36 disclosed herein include a plurality of fins 50. In some embodiments, the fins 50 are formed from a continuous strip of fin material folded in a ribbon-like serpentine fashion thereby providing a plurality of closely spaced fins 50 that extend generally orthogonally to the heat exchange tube segments 36. Thermal energy exchange between one or more fluids within the heat exchange tube segments 36 and an air flow A occurs through the outside surfaces 44, 46 of the heat exchange tube segments 36 collectively forming a primary heat exchange surface, and also through thermal energy exchange with the fins 50, which defines a secondary heat exchange surface.

Figure 4:
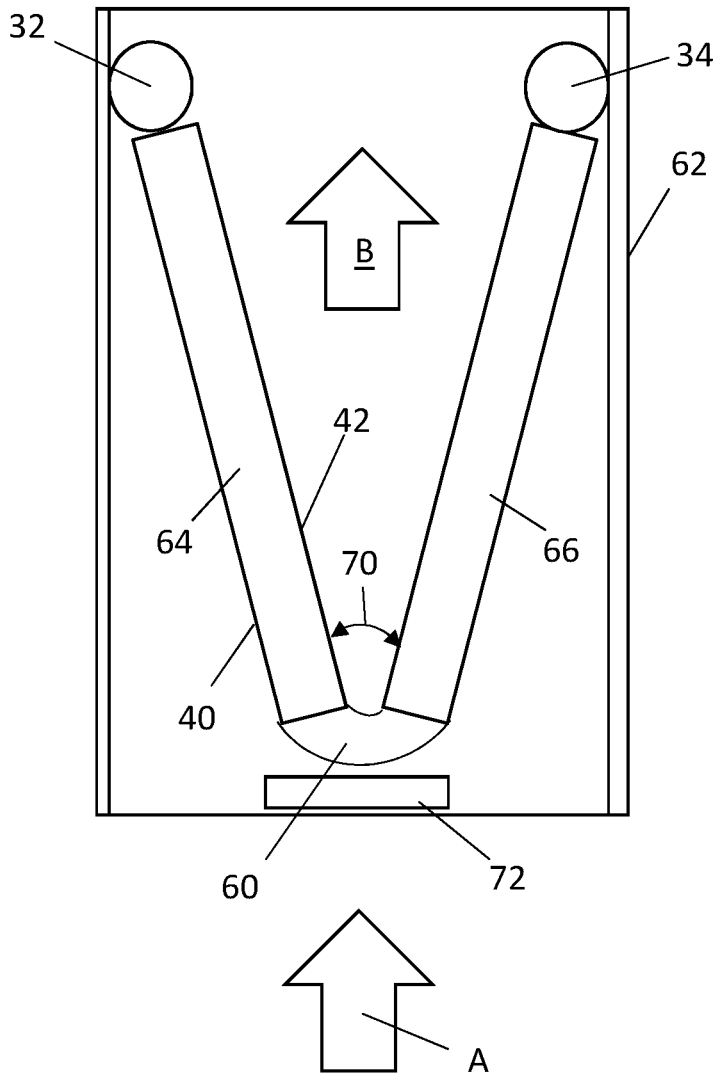
FIG. 4 is a schematic illustration of an embodiment of an evaporator inside a cabinet.

As illustrated in FIG. 4, a bend 60 is formed in each heat exchange tube segment 36 of the evaporator 24, resulting in a V-shape of the evaporator 24. In some embodiments the bend 60 has an included bend angle 70 less than 90 degrees. In other embodiments the included bend angle 70 is between 15 and 45 degrees. The evaporator 24 may be placed in a housing 62, or cabinet, with the bend 60 oriented such that the bend is closest to the incoming airflow A. A first leg 64 of the evaporator 24 extends from the bend 60 toward the first header 32 and a second leg 66 of the evaporator extends from the bend 60 toward the second header 34. In some embodiments, the evaporator 24 is situated in the housing 62 such that the bend 60 is located vertically lower than the first header 32 and the second header 34. The evaporator 24 may be secured in the housing 62 via the first header 32 and the second header 34.

A drain pan 72 is located vertically below the bend 60 to capture condensation from the heat exchange tube segments 36 and fins 50. The V arrangement of the evaporator 24 encourages the condensation to run down the first leg 64 and the second leg 66 toward the bend 60, where the condensation falls from the bend 60. The V orientation of the evaporator 24 allows for the use of a drain pan 72 with a smaller size and less compact shape than those used in other configurations, such as an evaporator with an A-shaped orientation relative to the incoming airflow A.

As the incoming airflow A passes through the evaporator 24, it proceeds between the first leg 64 and the second leg 66 as cold discharge air B. Thus, the configuration reduces the amount of the housing 62 exposed to the cold discharge air B, potentially reducing cabinet sweat on the outside of the housing 62 in humid environments. Further, the need for insulation of the housing 62 may be reduced. Further, the configuration allows for significant mixing of the cold discharge air B in the area between the first leg 64 and the second leg 66 improving homogeneity of the cold discharge air B. Further, with the illustrated configuration, condensate flows in the opposite direction of the refrigerant, thus eliminating spitting, or ejection of the condensate into a furnace. Additionally, with the disclosed configurations, the headers 34, 34 and the joints between the headers 32, 34 and legs 64, 66 are raised, and not resting in condensate the drain pan 72, thus reducing corrosion of the joints.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger, comprising:

a plurality of heat exchange tube segments defining a plurality of fluid pathways therein; and a bend formed in the plurality of heat exchange tube segments defining a first leg of the heat exchanger disposed at a first side of the bend, and a second leg of the heat exchanger disposed at a second side of the bend opposite the first side;

wherein the heat exchanger is positioned relative to a flow direction of an incoming airflow such that the bend is closer to a source of the incoming airflow than the first leg and the second leg;

wherein the bend is positioned lower vertically than the first leg and the second leg.

2. The heat exchanger of claim 1, further comprising a drain pan positioned vertically below the bend.

3. The heat exchanger of claim 1, wherein the first leg and the second leg define a mixing area therebetween for mixing of a discharge airflow of the heat exchanger.

4. The heat exchanger of claim 1, further comprising a header disposed at at least one of the first leg or the second leg.

5. The heat exchanger of claim 1, wherein the heat exchanger is installed in a housing/cabinet substantially surrounding the heat exchanger.

6. The heat exchanger of claim 1, wherein the bend has an included bend angle of 90 degrees or less.

7. The heat exchanger of claim 6, wherein the bend angle is between 15 and 45 degrees.

8. The heat exchanger of claim 1, wherein the heat exchanger is substantially V-shaped.

9. The heat exchanger of claim 1, wherein the heat exchanger is configured as an evaporator of a vapor compression cycle.

10. A heating, ventilation and air conditioning system, comprising:

a condenser configured to condense a flow of refrigerant flowing therethrough; and an evaporator operably connected to the condenser and configured to exchange thermal energy between the refrigerant flowing through the evaporator and an airflow directed across the evaporator, the evaporator including:

a plurality of heat exchange tube segments defining a plurality of fluid pathways therein; and a bend formed in the plurality of heat exchange tube segments defining a first leg of the evaporator disposed at a first side of the bend, and a second leg of the evaporator disposed at a second side of the bend opposite the first side;

wherein the evaporator is positioned relative to a flow direction of an incoming airflow such that the bend is closer to a source of the incoming airflow than the first leg and the second leg;

wherein the bend is positioned lower vertically than the first leg and the second leg.

11. The heating, ventilation and air conditioning system of claim 10, further comprising a drain pan positioned vertically below the bend.

12. The heating, ventilation and air conditioning system of claim 10, wherein the first leg and the second leg define a mixing area therebetween for mixing of a discharge airflow of the heat exchanger.

13. The heating, ventilation and air conditioning system of claim 10, further comprising a header disposed at at least one of the first leg or the second leg.

14. The heating, ventilation and air conditioning system of claim 10, wherein the evaporator is installed in a housing/cabinet substantially surrounding the evaporator.

15. The heating, ventilation and air conditioning system of claim 10, wherein the bend has an included bend angle of 90 degrees or less.

16. The heating, ventilation and air conditioning system of claim 15, wherein the bend angle is between 15 and 45 degrees.

17. The heating, ventilation and air conditioning system of claim 10, wherein the evaporator is substantially V-shaped.

18. The heating, ventilation and air conditioning system of claim 10, further comprising one or more fins extending between adjacent heat exchange tube segments of the plurality of heat exchange tube segments.

* * * * *